US007455571B1

(12) United States Patent
Kuo et al.

(10) Patent No.: US 7,455,571 B1
(45) Date of Patent: Nov. 25, 2008

(54) WINDOW POLISHING PAD

(75) Inventors: Charles C. Kuo, Westlake, OH (US); Jennifer M. O'Sullivan, Wilmington, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 11/765,649

(22) Filed: Jun. 20, 2007

(51) Int. Cl.
*B24B 1/00* (2006.01)
*B24D 11/00* (2006.01)

(52) U.S. Cl. ..... 451/41; 451/36; 451/59; 451/63; 451/533; 451/550

(58) Field of Classification Search ..... 451/36, 451/41, 59, 63, 527, 529, 533, 550
See application file for complete search history.

(56) References Cited

U.S. PATENT DOCUMENTS 6,620,036 B2 9/2003 Freeman et al.
6,623,331 B2 9/2003 Sevilla et al.
6,688,945 B2 2/2004 Liu
6,783,437 B1 8/2004 He
6,875,077 B2 4/2005 Petroski et al.
7,163,437 B1 1/2007 Swedek et al.
7,189,141 B2 3/2007 Tolles
7,252,871 B2 * 8/2007 Crkvenac et al. ..... 428/188
2007/0037487 A1 2/2007 Kuo et al.
2007/0054602 A1 3/2007 Bottema et al.

* cited by examiner

*Primary Examiner*—Timothy V Eley
(74) *Attorney, Agent, or Firm*—Thomas S. Deibert

(57) ABSTRACT

A window polishing pad having a reduced stress pad window formed therein for performing optical end point detection are provided, wherein the window polishing pad comprises a pad window and a pressure relief channel, wherein the pressure relief channel extends to an outer periphery of the window polishing pad from a cavity formed behind the pad window when the window polishing pad is interfaced with a platen and wherein a membrane is provided over at least one of an inlet and an outlet of the pressure relief channel. Also disclosed are methods of making and of using the window polishing pads to polish a semiconductor wafer.

10 Claims, 16 Drawing Sheets

WINDOW POLISHING PAD

The present invention relates to window polishing pads for chemical mechanical planarization (CMP), and in particular, relates to window polishing pads having reduced stress windows formed therein for performing optical end-point detection. In particular, the present invention relates to window polishing pads having a sealed pressure relief channel to reduce stress on the window and to minimize contamination of the window area.

In the fabrication of integrated circuits and other electronic devices, multiple layers of conducting, semiconducting and dielectric materials are deposited on or removed from a surface of a semiconductor wafer. Thin layers of conducting, semiconducting, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the wafer becomes nonplanar. Because subsequent semiconductor processing (e.g., metallization) requires the wafer to have a flat surface, the wafer needs to be planarized. Planarization is useful in removing undesired surface topography and surface defects, such as rough surfaces, agglomerated materials, crystal lattice damage, scratches, and contaminated layers or materials.

Chemical mechanical planarization, or chemical mechanical polishing (CMP), is a common technique used to planarize substrates, such as semiconductor wafers. In conventional CMP, a wafer carrier is mounted on a carrier assembly and positioned in contact with a polishing pad in a CMP apparatus. The carrier assembly provides a controllable pressure to the wafer, pressing it against the polishing pad. The pad is moved (e.g., rotated) relative to the wafer by an external driving force. Simultaneously therewith, a chemical composition ("slurry") or other polishing solution is provided between the wafer and the window polishing pad. Thus, the wafer surface is polished and made planar by the chemical and mechanical action of the pad surface and slurry.

An important step in planarizing a wafer is determining an end-point to the process. Accordingly, a variety of planarization end-point detection methods have been developed, for example, methods involving optical in-situ measurements of the wafer surface. The optical technique involves providing the window polishing pad with a window for select wavelengths of light. A light beam is directed through the window to the wafer surface, where it reflects and passes back through the window to a detector (e.g., a spectrophotometer). Based on the return signal, properties of the wafer surface (e.g., the thickness of films) can be determined for end-point detection.

Roberts, in U.S. Pat. No. 5,605,760, discloses a window polishing pad having a window formed therein. In Roberts, a window is cast and inserted into a flowable polishing pad polymer. This window polishing pad may be utilized in a stacked configuration (i.e., with a subpad) or used alone, directly adhered on the platen of a polishing apparatus with an adhesive. In either case, there is a "cavity" or space that is created between the window and the platen. It is believed that during polishing operations air pressure builds up in this cavity and may contribute to buldging of the window. Bulges in the window can create non-uniformities on the polished surface, and can cause the pad to breakthrough or slip/break wafers during the polishing process. In addition, any deformation of the window can introduce error to the endpoint detection signal that is used to stop the polish operation. This can in turn cause wafers to be damaged. Also, any bulging of the window may create excessive wear of the window material. Also, if the polishing slurry or water vapor enters the cavity it may deposit on the cavity side of the window. The presence of this material on the cavity side of the window can interfere with the endpoint detection process.

United States Patent Application Publication No. 2007/0054602 to Bottema et al. disclose a platen assembly for use in chemical mechanical polishing of semiconductor devices. Specifically, Bottema et al. disclose an apparatus for use in performing chemical mechanical polishing, comprising: a platen comprising a vented platen endpoint window and an upper surface for adhesive attachment of a polishing pad; and at least one vent pathway formed in the platen to connect the vented platen endpoint window with an opening in the platen, such that air between the vented platen endpoint window and the polishing pad is able to vent through the vented platen endpoint window and the vent pathway without allowing contaminants from the polishing process to infiltrate between the platen and the polishing pad.

Nevertheless, there remains a need for identifying new way to alleviate the build up of pressure in the cavity between the pad window and the platen and to minimize the potential for water vapor or slurry contamination in the cavity. In particular, there remains a need for identifying new ways to design chemical mechanical polishing consumables to alleviate these problems, hence avoiding the need to purchase new capital equipment as a remedy.

In one aspect of the present invention, there is provided a chemical mechanical window polishing pad comprising: a polishing layer having a polishing surface and a first aperture; a base layer having a second aperture, wherein the base layer underlies the polishing layer and the second aperture is aligned with the first aperture; and, a pad window disposed within the first aperture; wherein the window polishing pad has a pressure relief channel extending from an inlet at the second aperture to an outlet at an outer periphery of the window polishing pad; wherein the pressure relief channel does not extend to the polishing surface; wherein at least one of the inlet or outlet is covered with a semipermeable pad membrane and wherein the semipermeable pad membrane is gas permeable and liquid impermeable.

In another aspect of the present invention, there is provided a chemical mechanical window polishing pad comprising: a polishing layer having a polishing surface and a first aperture; a base layer having a second aperture, wherein the base layer underlies the polishing layer and the second aperture is aligned with the first aperture; and, a pad window disposed within the first aperture; wherein the window polishing pad has a pressure relief channel extending from an inlet at the second aperture to an outlet at an outer periphery of the window polishing pad; wherein the pressure relief channel does not extend to the polishing surface; wherein at least one of the inlet or outlet is covered with a semipermeable pad membrane; wherein the semipermeable pad membrane is gas permeable and liquid impermeable and wherein a porous filler material is disposed within the pressure relief channel.

In another aspect of the present invention, there is provided a method for making a window polishing pad, comprising: providing a polishing layer having a polishing surface and a first aperture; providing a base layer having a second aperture; providing a pressure relief channel extending from an inlet at the second aperture to and an outlet at an outer periphery of the window polishing pad; providing a pad window; providing a semipermeable pad membrane which is gas permeable and liquid impermeable; adhering the pad window within the first aperture; adhering the polishing layer to the base layer so that the first aperture and the second aperture are aligned; and, adhering the semipermeable pad membrane to the window polishing pad, such that the outlet from the pressure relief channel is covered by the semipermeable pad membrane; and, wherein the pressure relief channel does not extend to the polishing surface.

In another aspect of the present invention, there is provided a method for making a window polishing pad, comprising: providing a polishing layer having a polishing surface and a first aperture; providing a base layer having a second aperture; providing a pressure relief channel extending from an inlet at the second aperture to an outlet at an outer periphery of the window polishing pad; providing a porous filler material in the pressure relief channel; providing a pad window; providing a semipermeable pad membrane which is gas permeable and liquid impermeable; adhering the pad window within the first aperture; adhering the polishing layer to the base layer so that the first aperture and the second aperture are aligned; and, adhering the semipermeable pad membrane to the window polishing pad, such that the outlet from the pressure relief channel is covered by the semipermeable pad membrane; and, wherein the pressure relief channel does not extend to the polishing surface.

In another aspect of the present invention, there is provided a method for making a window polishing pad, comprising: providing a polishing layer having a polishing surface and a first aperture; providing a base layer having a second aperture; providing a pressure relief channel extending from an inlet at the second aperture to an outlet at an outer periphery of the window polishing pad; providing a porous filler material in the pressure relief channel; providing a pad window; providing a semipermeable pad membrane which is gas permeable and liquid impermeable; adhering the pad window within the first aperture; providing an adhesive selected from a pressure sensitive adhesive and a hot melt adhesive; using the adhesive to adhere the polishing layer to the base layer so that the first aperture and the second aperture are aligned; and, adhering the semipermeable pad membrane to the window polishing pad, such that the outlet from the pressure relief channel is covered by the semipermeable pad membrane; and, wherein the pressure relief channel does not extend to the polishing surface.

In another aspect of the present invention, there is provided a method for polishing a semiconductor wafer using a window polishing pad of the present invention, wherein the window polishing pad is interface with a platen on a polishing machine and polishing the wafer to an optically detected endpoint.

Figure 1:
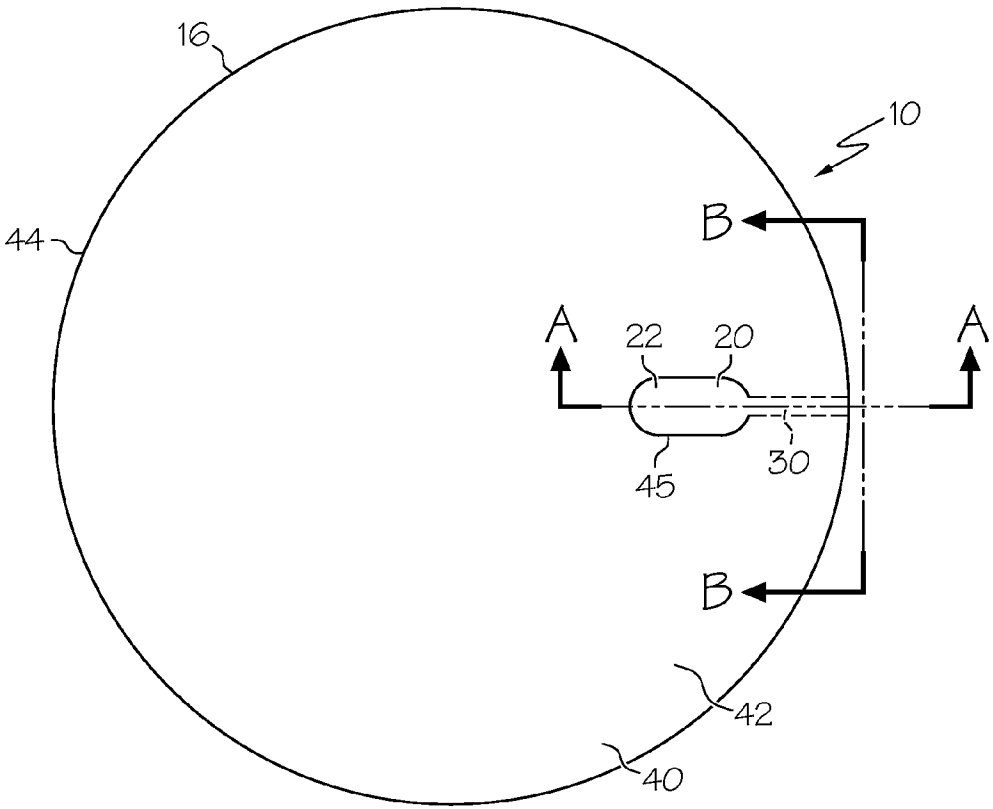
FIG. 1 depicts a top plan view of one embodiment of a window polishing pad of the present invention.

The present invention is described with respect to end point detection through a pad window using a laser spectrophotometer, the invention is not so limited, however. For example, the polishing layer can be adapted to accommodate other end point detection methods, such as, measuring the resistance across a polishing surface of the wafer.

Also, the present invention is described with respect to a two layer window polishing pad comprising a polishing layer and a base layer. One of ordinary skill in the art will recognize that the window polishing pads of the present invention can include one or more additional layers interposed between the polishing layer and the base layer.

In some embodiments of the present invention, the semipermeable pad membrane impedes the flow of contaminants (e.g., water and/or slurry) into the cavity through the pressure relief channel, while allowing the flow of gas into or out of the cavity through the pressure relief channel. In some aspects of these embodiments, the semipermeable pad membrane comprises any material that allows gas to flow through it, while excluding the flow of water therethrough and which is compatible with the other materials used in the window polishing pad and with water. In some aspects of these embodiments, the semipermeable pad membrane comprises (alkyl)acrylates, polyester, polyethylene, polypropylene, fluoropolymer, polyurethane foamed film, silicone, nylon, silk, polyethylene terephthalate (PET), derivatives thereof and combinations thereof. In some aspects of these embodiments, the semipermeable pad membrane comprises a fluoropolymer. In some aspects of these embodiments, the semipermeable pad membrane comprises polytetrafluoroethylene (PTFE). In some aspects of these embodiments, the semipermeable pad membrane is made from an expanded polytetrafluoroethylene (ePTFE), preferably and ePTFE having a node-fibril structure. ePTFE membranes having a node-fibril structure are commercially available from W.L. Gore and Associates. Other commercially available membrane materials include modified acrylic copolymer membranes (e.g., VERSAPOR® membranes, manufactured by Gelman Sciences), modified polyvinylidene fluoride membranes (e.g., DURAPELL™ membranes, manufactured by the Millipore Corporation, Bedford, Mass.) and other microporous materials that are commonly used to relieve pressure from enclosures.

In some embodiments of the present invention, the semipermeable pad membrane comprises a multilayer structure, wherein each layer comprises a thin film of ePTFE. In some embodiments, the semipermeable pad membrane comprises 1 to 200 layers. In some embodiments, the semipermeable pad membrane comprises 2 to 20 layers. In some aspects of these embodiments, each layer is 0.0025 to 0.025 mm thick; preferably 0.01 to 0.02; more preferably 0.012 to 0.013. In some aspects of these embodiments, the individual layers in the multilayer structure are laminated together. One of ordinary skill in the art will recognize that the strength properties of a thin film of ePTFE depends in part on the film drawing direction. In some aspects of these embodiments, the individual layers in the multilayer structure are cross laminated by placing superimposed sheets on one another such that the film drawing direction of the layers is angularly offset relative to one another by an angle of >0° and <180°. One of ordinary skill in the art will recognize that by offsetting the film drawing direction from layer to layer, the mechanical properties of the final membrane can be enhanced. In some aspects of these embodiments, the membrane is manufactured by laminating 8 plies of ePTFE film. In some aspects of these embodiments, the membrane is manufactured by laminating 4 plies of ePTFE film. In some aspects of these embodiments, the laminated ePTFE sheets are then sintered together at temperatures of about 370° C., under vacuum to adhere the film layers to one another.

In some embodiments of the present invention, the semipermeable pad membrane extends beyond the outlet or inlet of the pressure relief channel to facilitate joining the semipermeable pad membrane to the window polishing pad. In some aspects of these embodiments, the semipermeable pad membrane extends beyond the outlet by ≦0.5 inches along the periphery of the base layer on at least one side of the outlet. In some aspects of these embodiments, the semipermeable pad membrane extends beyond the outlet by ≦0.4 inches along the periphery of the base layer on at least one side of the outlet. In some aspects of these embodiments, the semipermeable pad membrane extends beyond the outlet by ≦0.2 inches along the periphery of the base layer on at least one side of the outlet. In some aspects of these embodiments, the semipermeable pad membrane extends beyond the outlet by 0.01 to 0.5 inches along the periphery of the base layer on at least one side of the outlet. In some aspects of these embodiments, the semipermeable pad membrane extends beyond the outlet by 0.1 to 0.2 inches along the periphery of the base layer on at least one side of the outlet. In some aspects of these embodiments, the semipermeable pad membrane is adhered to base layer. In some aspects of these embodiments, the semipermeable pad membrane is welded to the base layer. In some aspects of these embodiments, the semipermeable pad membrane is glued to the base layer. In some aspects of these embodiments, a portion of the semipermeable pad membrane is interposed between the polishing layer and the base layer. In some aspects of these embodiments, a portion of the semipermeable pad membrane is glued to both the polishing layer and the base layer.

In some embodiments of the present invention, a porous filler material is disposed in the pressure relief channel. In some aspects of these embodiments, the porous filler material is adhered within the pressure relief channel. In some aspects of these embodiments, the porous filler material is physically retained within the pressure relief channel by the polishing layer; a semipermeable pad membrane at the inlet and outlet of the pressure relief channel; and the base layer.

In some embodiments of the present invention, a porous filler material is disposed in the pressure relief channel at least one of the inlet and the outlet of the pressure relief channel to help support and retain in place the semipermeable pad membrane. In some aspects of these embodiments, the porous filler material is disposed in the pressure relief channel at both the inlet and the outlet of the pressure relief channel. In some aspects of these embodiments, the semipermeable pad membrane is anchored to the porous filler material to help hold the semipermeable pad membrane in place over the inlet or outlet of the pressure relief channel. In some aspects of these embodiments, the semipermeable pad membrane is anchored to the porous filler material using an adhesive selected from a pressure sensitive adhesive, a contact adhesive and a hot melt adhesive.

In some embodiments of the present invention, the porous filler material is anchored in the pressure relief channel and the semipermeable pad membrane(s) is (are) anchored to the porous filler material. In some aspects of these embodiments the semipermeable pad membrane is welded to the porous filler material. In some aspects of these embodiments, the semipermeable pad membrane is adhered to the porous filler material using an adhesive. In some aspects of these embodiments, the adhesive is selected from pressure sensitive adhesives, contact adhesives and hot melt adhesives.

It is believed that non-uniformities in compressibility of the window polishing pad can result in defects in semiconductor devices polished using the window polishing pad. Accordingly, in some embodiments of the present invention, the window polishing pad is spatially uniform with regard to compressibility.

In some embodiments of the present invention, only a portion of the pressure relief channel is filled with a porous filler material. One of ordinary skill in the art will recognize that typically a portion of the polishing surface of a window polishing pad at an outer periphery is not used to contact the semiconductor wafer during polishing. In some aspects of these embodiments, the portion of the pressure relief channel filled with porous filler material corresponds with the region of the polishing surface that is not used to contact the semiconductor wafer during processing. In some aspects of these embodiments, the portion of the pressure relief channel filled with porous filler material extends from the outer periphery of the pad to a point ≦0.5 inches in from the outer periphery. In some aspects of these embodiments, the portion of the pressure relief channel filled with porous filler material extends from the outer periphery of the pad to a point ≦0.2 inches in from the outer periphery. In some aspects of these embodiments, the portion of the pressure relief channel filled with porous filler material extends from the outer periphery of the pad to a point 0.1 to 0.5 inches in from the outer periphery. In some aspects of these embodiments, the portion of the pressure relief channel filled with porous filler material extends from the outer periphery of the pad to a point 0.1 to 0.2 inches in from the outer periphery. In some embodiments of the present invention, less than 95 vol % of the pressure relief channel is occupied by porous filler material. In some aspects of these embodiments, less than 50 vol % of the pressure relief channel is occupied by porous filler material. In some aspects of these embodiments, less than 25 vol % of the pressure relief channel is occupied by porous filler material.

In some embodiments of the present invention, the porous filler material is selected to have a compressibility that approximates the compressibility of the window polishing pad layer or layers in which the pressure relief channel is provided. One or ordinary skill in the art will know how to select materials for use as the porous filler material and will know how to modify the properties of those materials to match the compressibility of the porous filler material to the material used in forming the window polishing pad layer or layers in which the pressure relief channel is provided. In some aspects of these embodiments, the compressibility of the porous filler material is within ±10%, preferably within ±5%, of the compressibility of the window polishing pad layer or layers in which the pressure relief channel is provided. In some aspects of these embodiments, the pressure relief channel is provided in the polishing layer and the porous filler material exhibits a compressibility that approximates that of the polishing layer. In some aspects of these embodiments, the compressibility of the porous filler material is within ±10%, preferably ±5%, of the compressibility of the polishing layer. In some aspects of these embodiments, the pressure relief channel is provided in the base layer and the porous filler material exhibits a compressibility that approximates that of the base layer. In some aspects of these embodiments, the compressibility of the porous filler material is within ±10%, preferably ±5%, of the compressibility of the base layer.

In some embodiments of the present invention, the porous filler material is an open cell foam material. In some aspects of these embodiments, the porous filler material is prepared from the same material used to form the window polishing pad layer or layers in which the pressure relief channel is provided. In some aspects of these embodiments, the porous filler material is prepared from a different material from that used to form the window polishing pad layer or layers in which the pressure relief channel is provided.

In some embodiments of the present invention, the porous filler material comprises one or more additives to modify the compressibility of the porous filler material.

In some embodiments of the present invention, the porous filler material comprises one or more additives that increase the hydrophobicity of the porous filler material.

In some embodiments of the present invention, the base layer has a notch or cut-out portion along the outer periphery of the base layer which coincides with the outlet from the pressure relief channel. In some aspects of these embodiments, the notch or cut-out portion is designed to minimize the flow of slurry toward the outlet from the pressure relief channel during polishing.

In some embodiments of the present invention, at least a portion of the outer periphery of the window polishing pad is hydrophobic or treated to be hydrophobic. In some aspects of these embodiments, the wicking of moisture into the backing layer is reduced. In some aspects of these embodiments, only the outer periphery of the base layer is hydrophobic or treated to be hydrophobic.

In some embodiments of the present invention, the pressure relief channel is formed by a method selected from milling, cutting, die cutting, stamping, punching, molding, drilling and combinations thereof. In some aspects of these embodiments, the pressure relief channel is formed by milling a channel in a layer of the window polishing pad using a computer numerically controlled tool. In some aspects of these embodiments, the pressure relief channel is formed by laser cutting or knife cutting. In some aspects of these embodiments, the pressure relief channel is formed by molding a layer of the window polishing pad with the channel included as a molding feature. In some aspects of these embodiments, the pressure relief channel is formed by stamping. In some aspects of these embodiments, the pressure relief channel is formed by mechanical or laser drilling. In some aspects of these embodiments, the pressure relief channel is formed in the base layer. In some aspects of these embodiments, the pressure relief channel is formed in the polishing layer. In some aspects of these embodiments, the pressure relief channel is formed in a layer disposed between the polishing layer and the base layer. In some aspects of these embodiments, the pressure relief channel is formed in more than one layer of the window polishing pad. In some aspects of these embodiments, the pressure relief channel is formed in one or more layers before the layers are assembled into the window polishing pad. In some aspects of these embodiments, the pressure relief channel is formed in one or more layers after the layers are assembled into a window polishing pad.

In some embodiments, the pressure relief channel is not completely formed within a single layer of the window polishing pad. In some aspects of these embodiments, at least two layers of the window polishing pad comprise at least one wall of the pressure relief channel. In some aspects of these embodiments, the polishing layer and the base layer each comprise at least one wall of the pressure relief channel. In some aspects of these embodiments, the porous filler material is disposed within at least a portion of the pressure relief channel before the base layer and the polishing layer are adhered together. In some aspects of these embodiments, the presence of the porous filler material in the pressure relief channel hinders the flow into the pressure relief channel of any adhesive used to adhere the base layer and the polishing layer together.

In some embodiments of the present invention, the window polishing pad is constructed of a polishing layer and a base layer. In some aspects of these embodiments, the window polishing pad comprises additional layers disposed between the polishing layer and the base layer. In some aspects of these embodiments, the polishing layer and the base layer are joined together. In some aspects of these embodiments, the polishing layer and the base layer are joined by an adhesive layer. In some aspects of these embodiments, the adhesive layer comprises a pressure sensitive adhesive. In some aspects of these embodiments, the adhesive layer comprises a hot melt adhesive. In some aspects of these embodiments, the layers of the window polishing pad are mechanically interlinked, interconnected or joined together by physical overlap, interspersement, and/or interwinement of the layer materials from adjacent layers. In some aspects of these embodiments, the different layers of the window polishing pad are coextensive. In some aspects of these embodiments, the different layers of the window polishing pad are joined together without an adhesive, that is, the interface between the layers is adhesive free. The term "adhesive free" as used herein and in the appended claims in reference to the interface between adjacent layers of a window polishing pad of the present invention means that the layers are mechanically interlinked, interconnected or joined without any adhesive between the layers.

In some embodiments of the present invention, the polishing layer comprises a first aperture and the base layer comprises a second aperture. In some aspects of these embodiments, the second aperture is smaller than the first aperture. In some aspects of these embodiments, the polishing layer and the base layer are joined together such that the first aperture and the second aperture are aligned.

In some embodiments of the present invention, the pad window is disposed in the first aperture. In some aspects of these embodiments, the pad window is inserted in the first aperture and adhered to the polishing layer. In some aspects of these embodiments, the pad window is adhered to the base layer. In some aspects of these embodiments, the pad window is adhered to both the polishing layer and the base layer.

In some embodiments of the present invention, the window polishing pad is interfaced with a platen on a polishing machine to facilitate the polishing of a semiconductor wafer. In some aspects of these embodiments, the window polishing pad is interfaced with the platen using at least one of a pressure sensitive adhesive and vacuum.

In some embodiments of the present invention, the platen has one or more grooves on the surface which interfaces with the window polishing pad. In some aspects of these embodiments, at least one groove is in air flow communication with the cavity of the window polishing pad. In some aspects of these embodiments, at least one of the groove extends beyond the outer periphery of the window polishing pad during use when the window polishing pad is interfaced with the platen. In some aspects of these embodiments, the portion of the at least one groove the extends beyond the outer periphery of the window polishing pad is covered by a semipermeable platen membrane. In some aspects of these embodiments, the semipermeable platen membrane is attached to the platen. In some aspects of these embodiments, the semipermeable platen membrane is attached to the platen using at least one of an adhesive and vacuum.

In some embodiments of the present invention, the semipermeable platen membrane impedes the flow of contaminants (e.g., water and/or slurry) into the groove, while allowing the flow of gas into or out of the groove. In some aspects of these embodiments, the semipermeable platen membrane comprises any material that allows gas to flow through it, while excluding the flow of water therethrough. In some aspects of these embodiments, the semipermeable platen membrane comprises (alkyl)acrylates, polyester, polyethylene, polypropylene, fluoropolymer, polyurethane foamed film, silicone, nylon, silk, polyethylene terephthalate (PET), derivatives thereof and combinations thereof. In some aspects of these embodiments, the semipermeable platen membrane comprises a fluoropolymer. In some aspects of these embodiments, the semipermeable platen membrane comprises polytetrafluoroethylene (PTFE). In some aspects of these embodiments, the semipermeable platen membrane is made from an expanded polytetrafluoroethylene (ePTFE), preferable and ePTFE having a node-fibril structure. ePTFE membranes having a node-fibril structure are commercially available from W.L. Gore and Associates. Other commercially available membrane materials include modified acrylic copolymer membranes (e.g., VERSAPOR® membranes, manufactured by Gelman Sciences), modified polyvinylidene fluoride membranes (e.g., DURAPEL® membranes, manufactured by the Millipore Corporation, Bedford, Mass.) and other microporous materials that are commonly used to relieve pressure from enclosures.

In some embodiments of the present invention, the semipermeable platen membrane comprises a multilayer structure, wherein each layer comprises a thin film of ePTFE. In some embodiments, the semipermeable platen membrane comprises 1 to 200 layers. In some embodiments, the semipermeable platen membrane comprises 2 to 20 layers. In some aspects of these embodiments, each layer is 0.0025 to 0.025 mm thick; preferably 0.01 to 0.02; more preferably 0.012 to 0.013. In some aspects of these embodiments, the individual layers in the multilayer structure are laminated together. One of ordinary skill in the art will recognize that the strength properties of a thin film of ePTFE depends in part on the film drawing direction. In some aspects of these embodiments, the individual layers in the multilayer structure are cross laminated by placing superimposed sheets on one another such that the film drawing direction of the layers is angularly offset relative to one another by an angle of >0° and <180°. One of ordinary skill in the art will recognize that by offsetting the film drawing direction from layer to layer, the mechanical properties of the final membrane can be enhanced. In some aspects of these embodiments, the membrane is manufactured by laminating 8 plies of ePTFE film. In some aspects of these embodiments, the membrane is manufactured by laminating 4 plies of ePTFE film. In some aspects of these embodiments, the laminated ePTFE sheets are then sintered together at temperatures of about 370° C., under vacuum to adhere the film layers to one another.

FIG. 1 is a top plan view of a window polishing pad 10 of the present invention for use in polishing semiconductor wafers. The window polishing pad 10 depicted in FIG. 1 has a polishing surface 42 of a polishing layer 40, a polishing side 22 of a pad window 20 inserted in a first aperture 45 in polishing layer 40 and a pressure relief channel 30. The window polishing pad 10 depicted in FIG. 1 has an outer periphery 16 of the window polishing pad 10 that coincides with an outer periphery 44 of polishing layer 40.

Figure 2A:
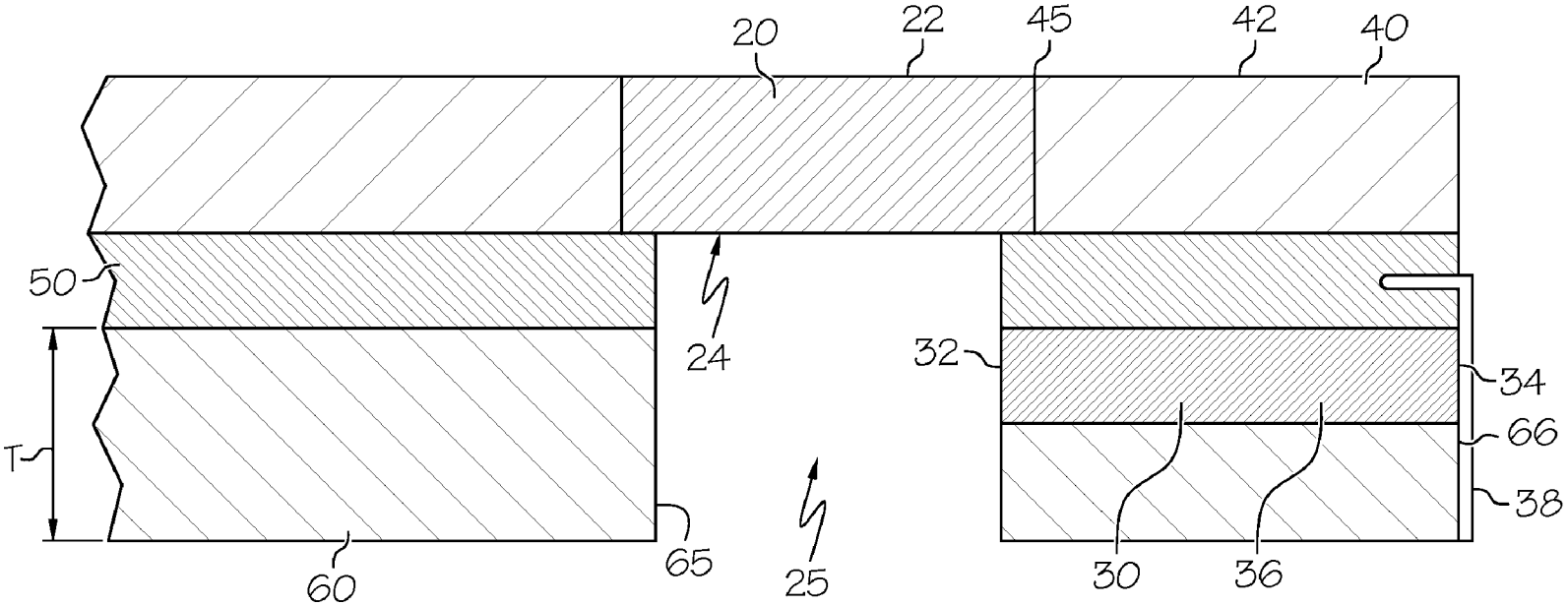
FIG. 2A depicts a cut-away, elevational view of one embodiment of a window polishing pad of the present invention through A-A of FIG. 1.

FIG. 2A depicts a cut-away, elevational view of one embodiment of a window polishing pad of the present invention through A-A of FIG. 1. The window polishing pad depicted in FIG. 2A has a polishing layer 40 having a polishing surface 42 and a first aperture 45, with a pad window 20 having a polishing side 22 disposed within the first aperture 45. The polishing layer 40 is attached to a base layer 60 by an adhesive layer 50. The base layer 60 has a thickness T and a second aperture 65 aligned with the first aperture 45. The window polishing pad has a cavity 25 defined by the second aperture 65 and a platen side 24 of the pad window 20. A pressure relief channel 30 is formed within or defined at least in part by the base layer 60 and extends from an inlet 32 to the second aperture 65 to an outlet 34 at an outer periphery 66 of the base layer 60. In the embodiment of the window polishing pad of the present invention depicted in FIG. 2A, the pressure relief channel 30 is filled with a porous filler material 36 and has a first semipermeable pad membrane 38 covering the outlet 34. In some aspects of this embodiment, the first semipermeable pad membrane 38 is attached to the porous filler material 36.

Figure 2B:
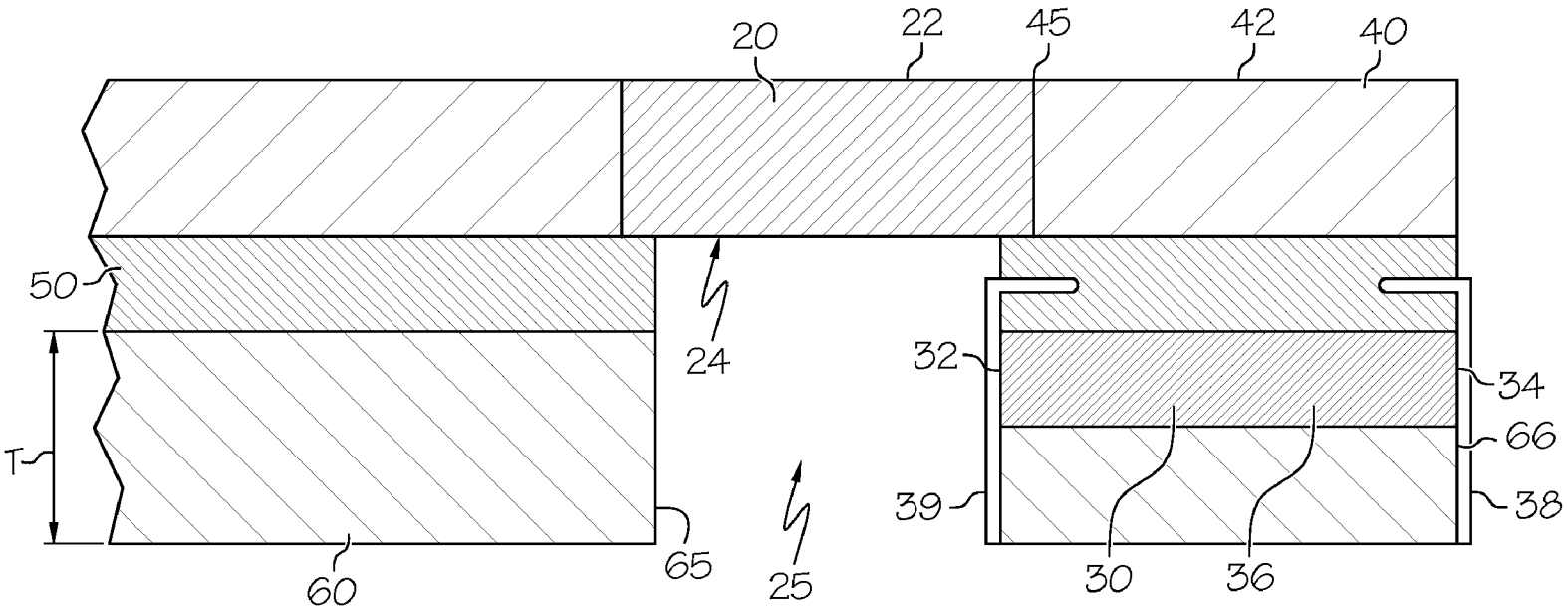
FIG. 2B depicts a cut-away, elevational view of another embodiment of a window polishing pad of the present invention through A-A of FIG. 1.

FIG. 2B depicts a cut-away, elevational view of another embodiment of a window polishing pad of the present invention through A-A of FIG. 1. The window polishing pad of the present invention depicted in FIG. 2B, has a pressure relief channel 30 filled with a porous filler material 36, a first semipermeable pad membrane 38 covering outlet 34 and a second semipermeable pad membrane 39 covering inlet 32. The first semipermeable pad membrane 38 and the second semipermeable pad membrane 39 can be made of the same material or a different material. In some aspects of this embodiment, at least one of the first semipermeable pad membrane 38 and the second semipermeable pad membrane 39 is attached to the porous filler material 36. In the window polishing pad of the present invention depicted in FIG. 2B, the pressure relief channel 30 does not extend all the way from the adhesive layer 50 down through the entire thickness T of base layer 60.

Figure 2C:
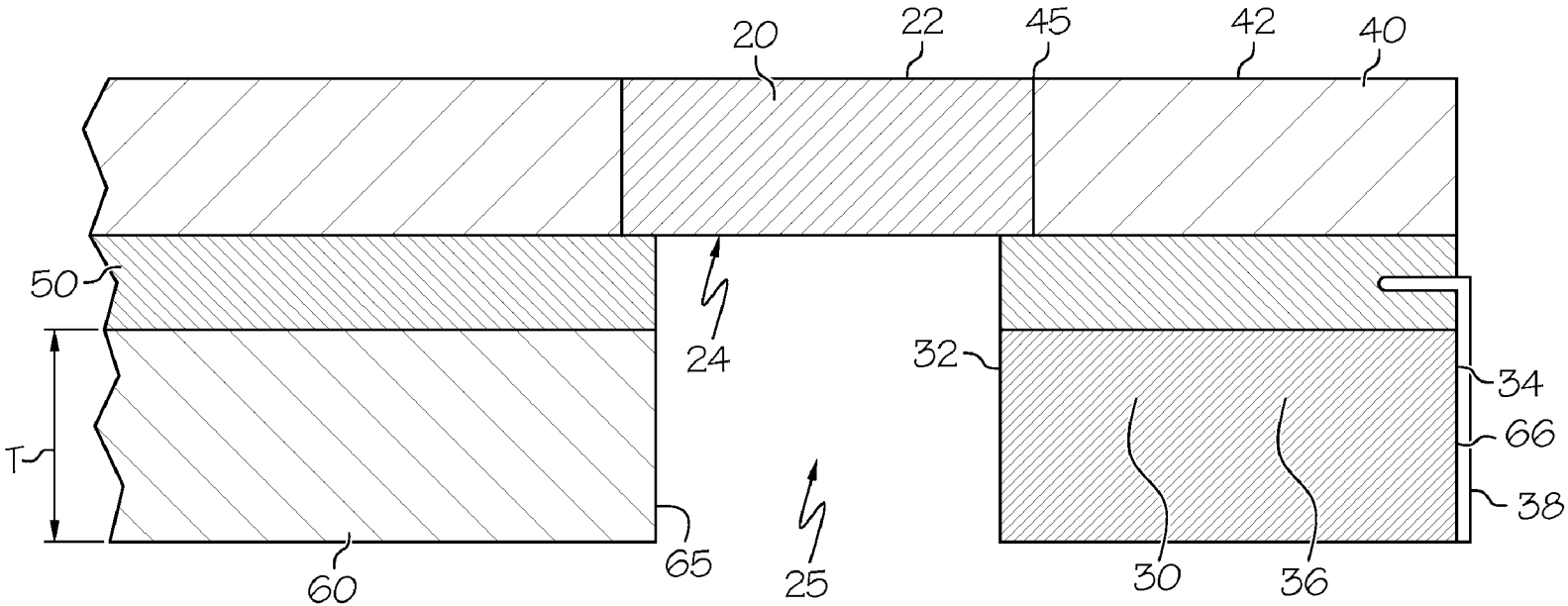
FIG. 2C depicts a cut-away, elevational view of another embodiment of a window polishing pad of the present invention through A-A of FIG. 1.

FIG. 2C depicts a cut-away, elevational view of another embodiment of a window polishing pad of the present invention through A-A of FIG. 1. The window polishing pad of the present invention depicted in FIG. 2C, has a pressure relief channel 30 filled with a porous filler material 36 and a first semipermeable pad membrane 38 covering outlet 34. In some aspects of this embodiment, the first semipermeable pad membrane 38 is attached to the porous filler material 36. In the window polishing pad of the present invention depicted in FIG. 2C, the pressure relief channel 30 extends all the way from the adhesive layer 50 down through the entire thickness T of base layer 60.

Figure 2D:
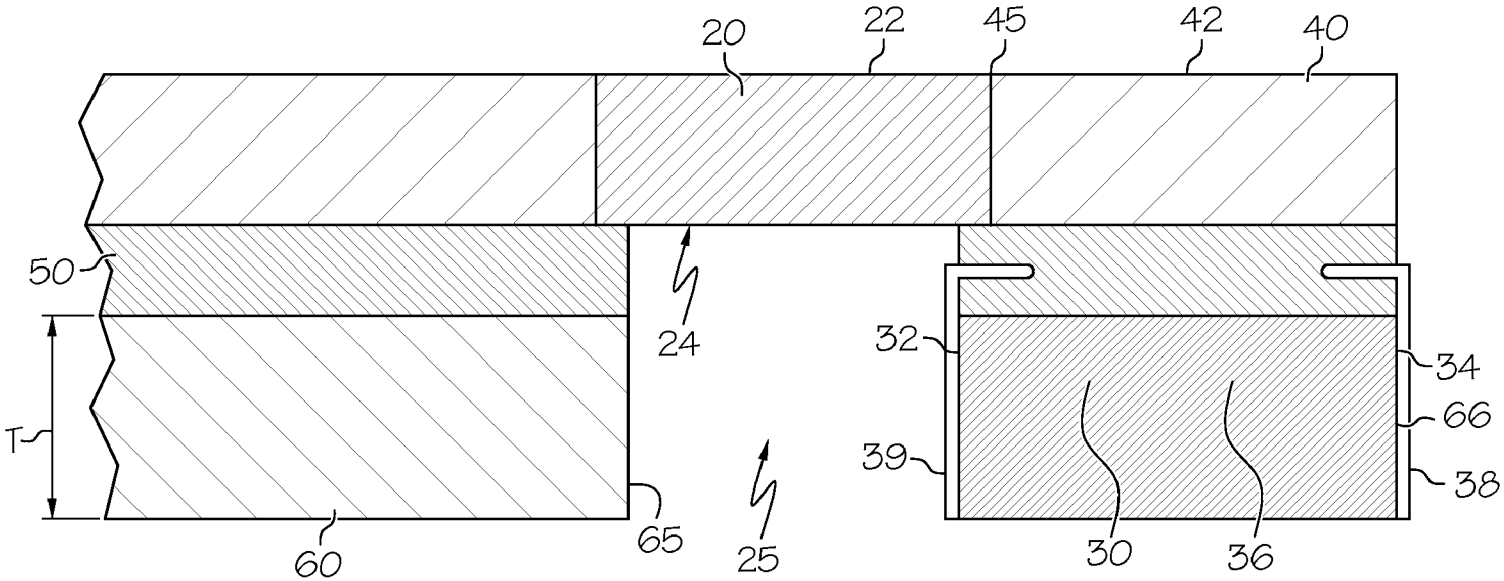
FIG. 2D depicts a cut-away, elevational view of another embodiment of a window polishing pad of the present invention through A-A of FIG. 1.

FIG. 2D depicts a cut-away, elevational view of another embodiment of a window polishing pad of the present invention through A-A of FIG. 1. The window polishing pad of the present invention depicted in FIG. 2D, has a pressure relief channel 30 filled with a porous filler material 36, a first semipermeable pad membrane 38 covering outlet 34 and a second semipermeable pad membrane 39 covering inlet 32. The first semipermeable pad membrane 38 and the second semipermeable pad membrane 39 can be the same or different. In some aspects of this embodiment, at least one of the first semipermeable pad membrane 38 and the second semipermeable pad membrane 39 is attached to the porous filler material 36. In the window polishing pad of the present invention depicted in FIG. 2D, the pressure relief channel 30 extends all the way from the adhesive layer 50 down through the entire thickness T of base layer 60.

Figure 2E:
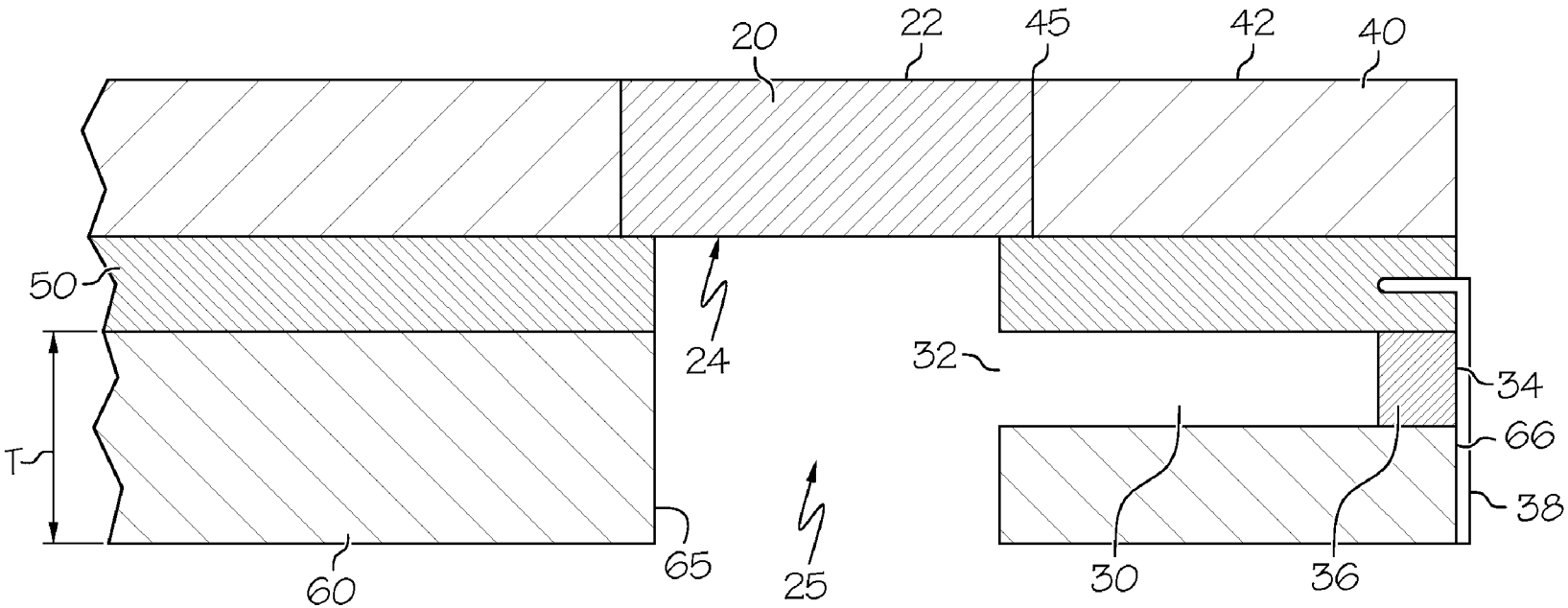
FIG. 2E depicts a cut-away, elevational view of another embodiment of a window polishing pad of the present invention through A-A of FIG. 1.

FIG. 2E depicts a cut-away, elevational view of another embodiment of a window polishing pad of the present invention through A-A of FIG. 1. The window polishing pad of the present invention depicted in FIG. 2E, has a pressure relief channel 30 that is only partially filled with a porous filler material 36 and a first semipermeable pad membrane 38 covering outlet 34. In some aspects of this embodiment, the first semipermeable pad membrane 38 is attached to the porous filler material 36. In the window polishing pad of the present invention depicted in FIG. 2E, the pressure relief channel 30 does not extend all the way from the adhesive layer 50 down through the entire thickness T of base layer 60.

Figure 2F:
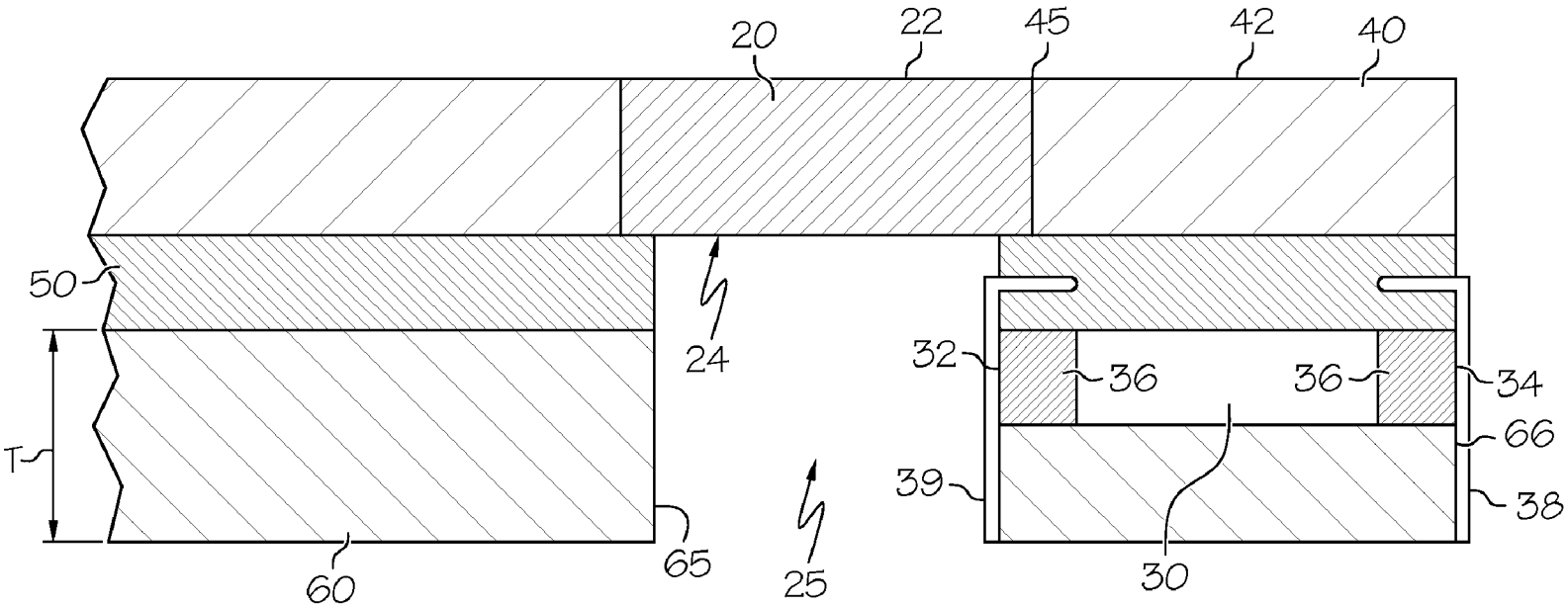
FIG. 2F depicts a cut-away, elevational view of another embodiment of a window polishing pad of the present invention through A-A of FIG. 1.

FIG. 2F depicts a cut-away, elevational view of another embodiment of a window polishing pad of the present invention through A-A of FIG. 1. The window polishing pad of the present invention depicted in FIG. 2F, has a pressure relief channel 30 that is only partially filled with a porous filler material 36, a first semipermeable pad membrane 38 covering outlet 34 and a second semipermeable pad membrane 39 covering inlet 32. In some aspects of this embodiment, at least one of the first semipermeable pad membrane 38 and the second semipermeable pad membrane are attached to the porous filler material 36. In the window polishing pad of the present invention depicted in FIG. 2F, the pressure relief channel 30 does not extend all the way from the adhesive layer 50 down through the entire thickness T of base layer 60.

Figure 2G:
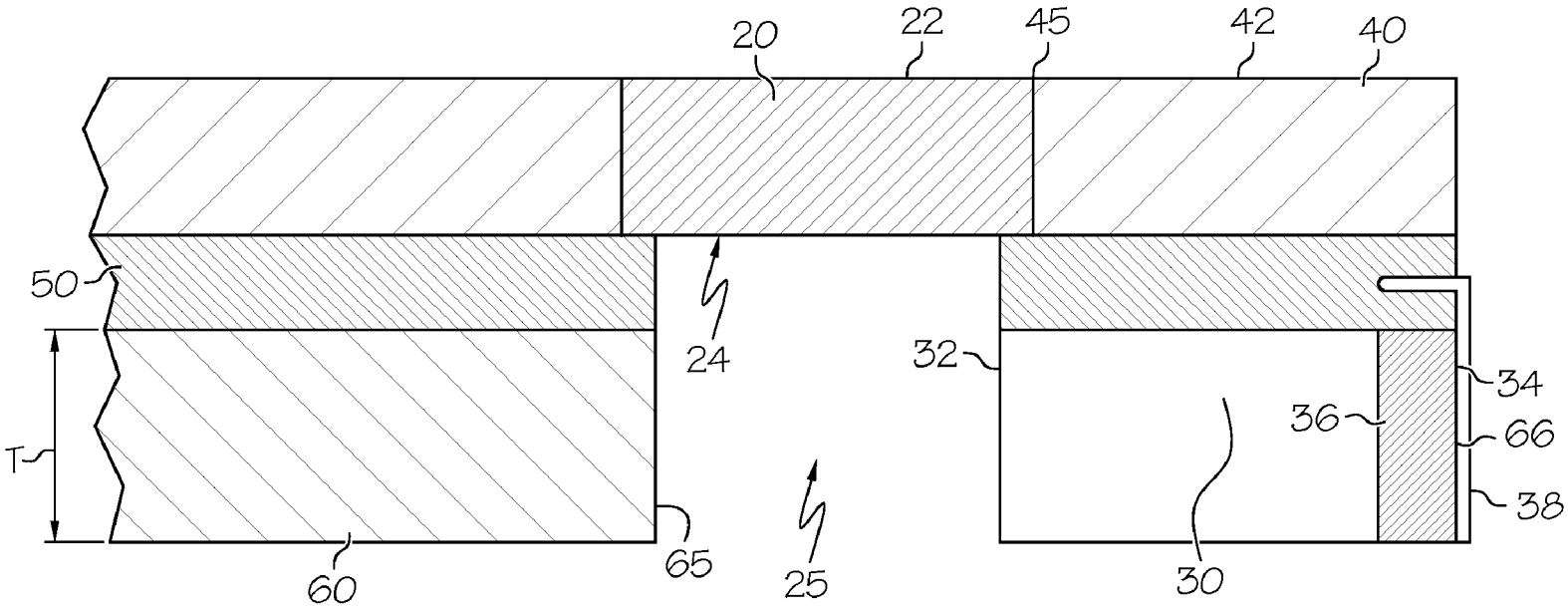
FIG. 2G depicts a cut-away, elevational view of another embodiment of a window polishing pad of the present invention through A-A of FIG. 1.

FIG. 2G depicts a cut-away, elevation view of another embodiment of a window polishing pad of the present invention through A-A of FIG. 1. The window polishing pad of the present invention depicted in FIG. 2G, has a pressure relief channel 30 that is only partially filled with a porous filler material 36 and a first semipermeable pad membrane 38 covering the outlet 34. In some aspects of this embodiment, the first semipermeable pad membrane 38 is attached to the porous filler material 36. In the window polishing pad of the present invention depicted in FIG. 2G, the pressure relief channel 30 extends all the way from the adhesive layer 50 down through the entire thickness T of base layer 60.

Figure 2H:
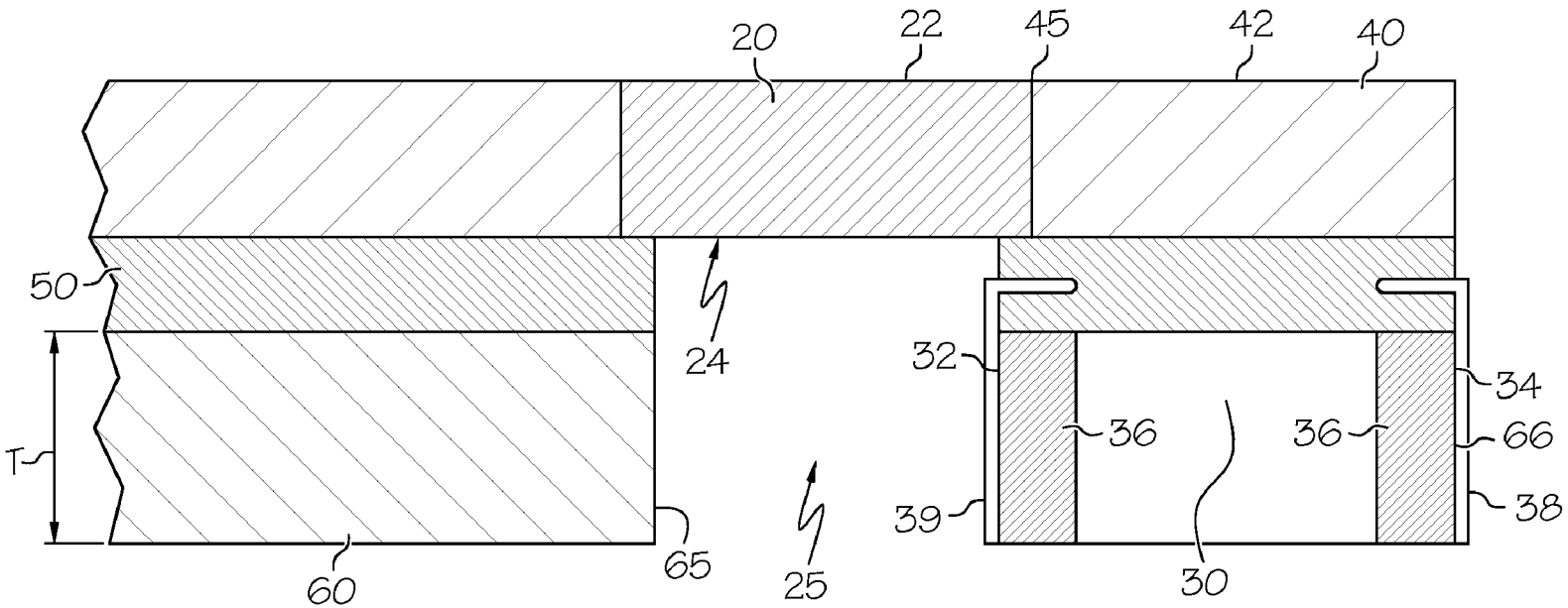
FIG. 2H depicts a cut-away, elevational view of another embodiment of a window polishing pad of the present invention through A-A of FIG. 1.

FIG. 2H depicts a cut-away, elevation view of another embodiment of a window polishing pad of the present invention through A-A of FIG. 1. The window polishing pad of the present invention depicted in FIG. 2H, has a pressure relief channel 30 that is only partially filled with a porous filler material 36, a first semipermeable pad membrane 38 covering outlet 34 and a second semipermeable pad membrane 39 covering inlet 32. In some aspects of this embodiment, at least one of the first semipermeable pad membrane 38 and the second semipermeable pad membrane 39 is attached to the porous filler material 36. In the window polishing pad of the present invention depicted in FIG. 9, the pressure relief channel 30 extends all the way from the adhesive layer 50 down through the entire thickness T of base layer 60.

Figure 3:
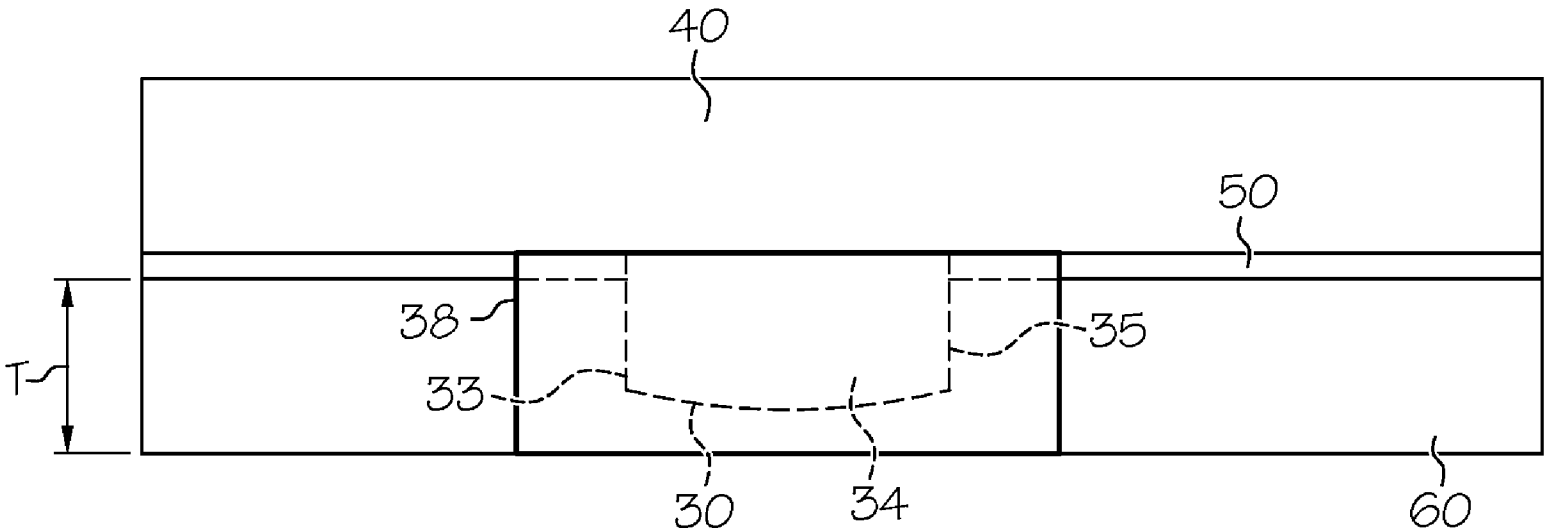
FIG. 3 is an elevational view of a window polishing pad of, for example FIG. 2A, from direction B-B of FIG. 1.

FIG. 3 is an elevational view of a window polishing pad of, for example FIG. 2C, from direction B-B of FIG. 1. In the window polishing pad depicted in FIG. 3, pressure relief channel 30 does not extend all the way from the adhesive layer 50 down through the entire thickness T of base layer 60. In some aspects of these embodiments, the first semipermeable pad membrane 38 extends beyond the sides 33 and 35 of outlet 34 of pressure relief channel 30.

Figure 4:
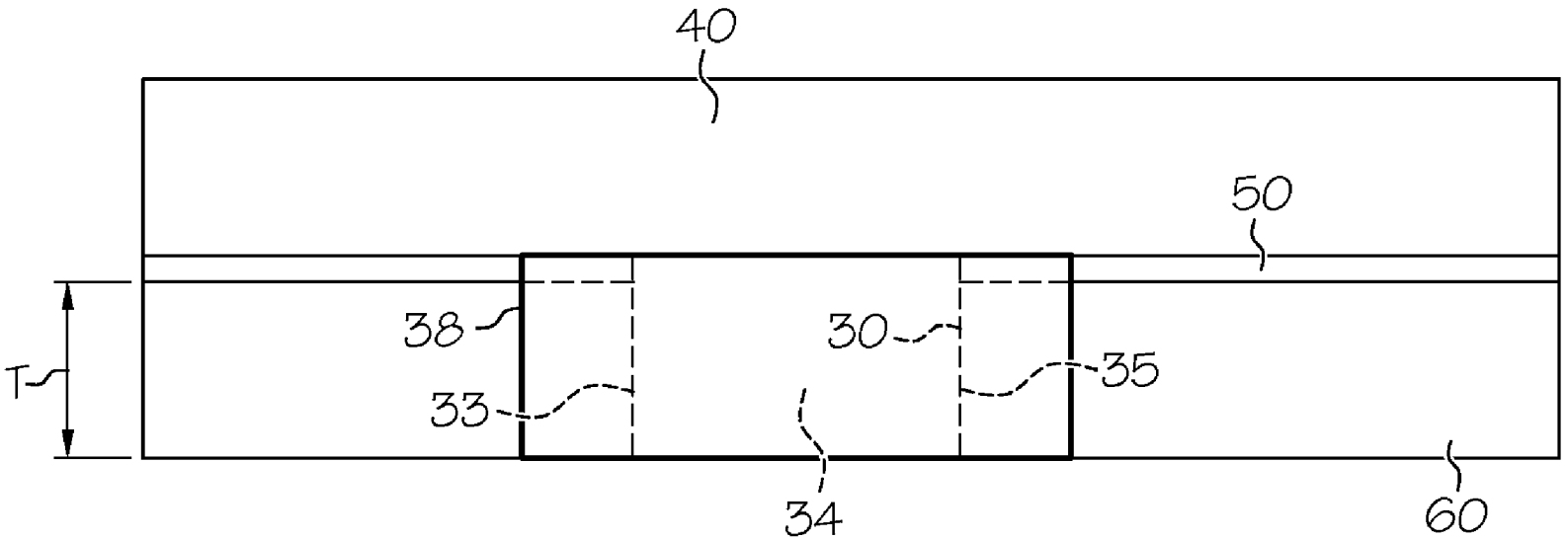
FIG. 4 is an elevational view of a window polishing pad of, for example FIG. 2C, from direction B-B of FIG. 1.

FIG. 4 is an elevational view of a window polishing pad of, for example FIG. 2C, from direction B-B of FIG. 1. In the window polishing pad depicted in FIG. 4, pressure relief channel 30 extends all the way from the adhesive layer 50 down through the entire thickness T of base layer 60. In some aspects of these embodiments, the first semipermeable pad membrane 38 extends beyond the sides 33 and 35 of outlet 34 of the pressure relief channel 30.

Figure 5A:
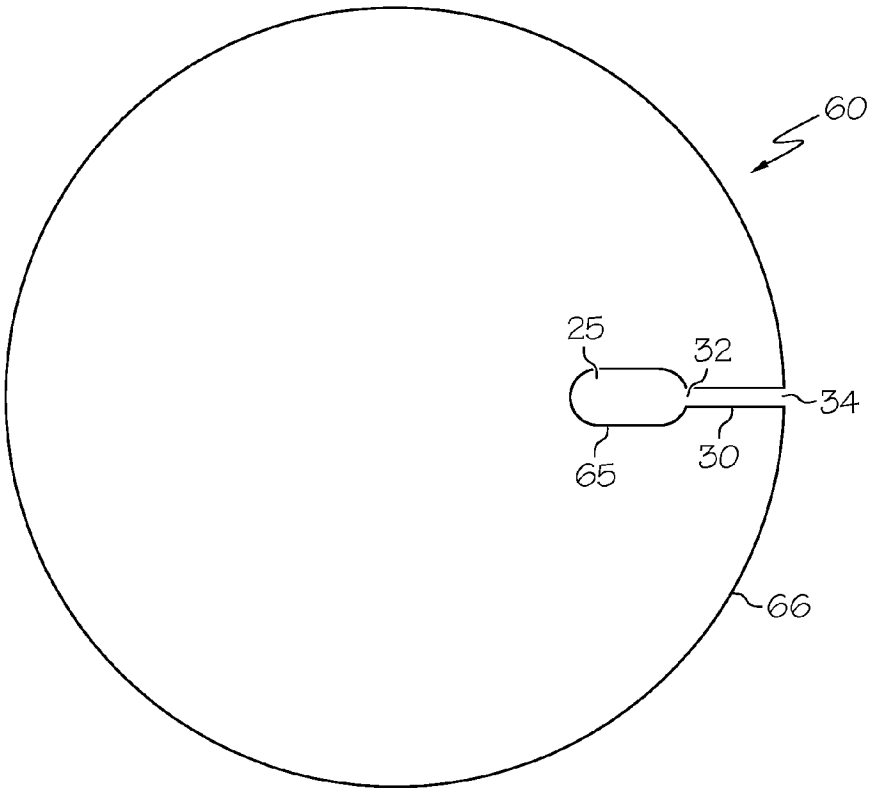
FIG. 5A is a top plan view of one embodiment of a base layer of a window polishing pad of the present invention.

FIG. 5A is a top plan view of one embodiment of a base layer 60 of the present invention with a second aperture 65 forming a cavity 25, and a pressure relief channel 30 having an inlet 32 and an outlet 34. In the embodiment of the window polishing pad of the present invention depicted in FIG. 5A, the base layer 60 does not exhibit a notch along the outer periphery 66.

Figure 5B:
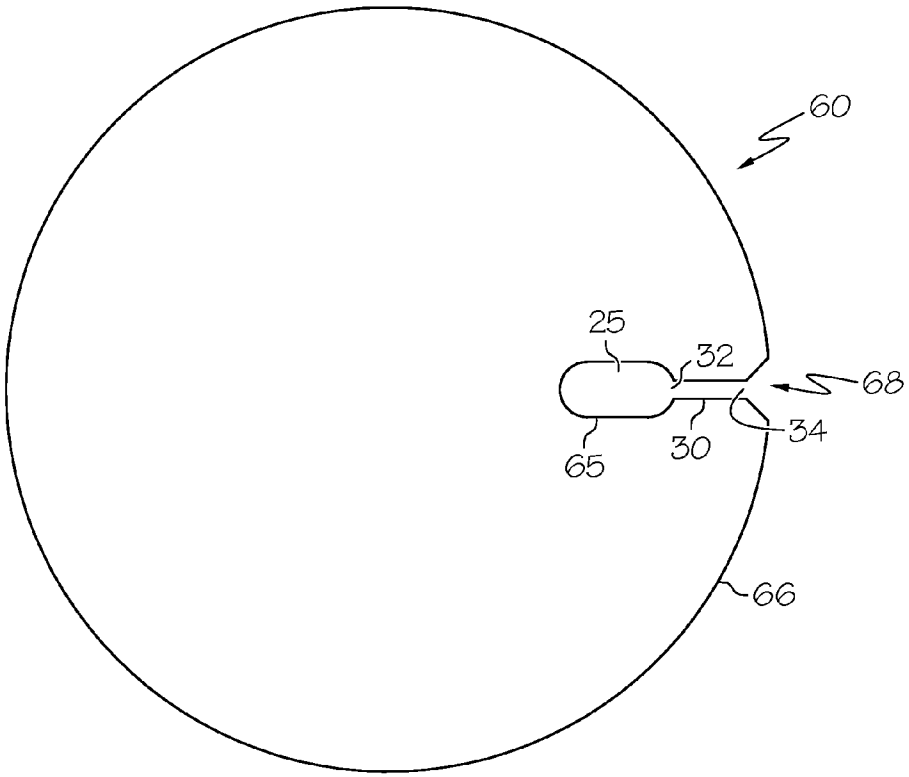
FIG. 5B is a top plan view of another embodiment of a base layer of a window polishing pad of the present invention.

FIG. 5B is a top plan view of another embodiment of a base layer 60 of the present invention with a second aperture 65 forming a cavity 25, and a pressure relief channel 30 having an inlet 32 and an outlet 34. In the embodiment of the window polishing pad of the present invention depicted in FIG. 5B, the base layer 60 has a notch 68 along the outer periphery 66 that coincides with the outlet 34 of the pressure relief channel 30.

Figure 6:
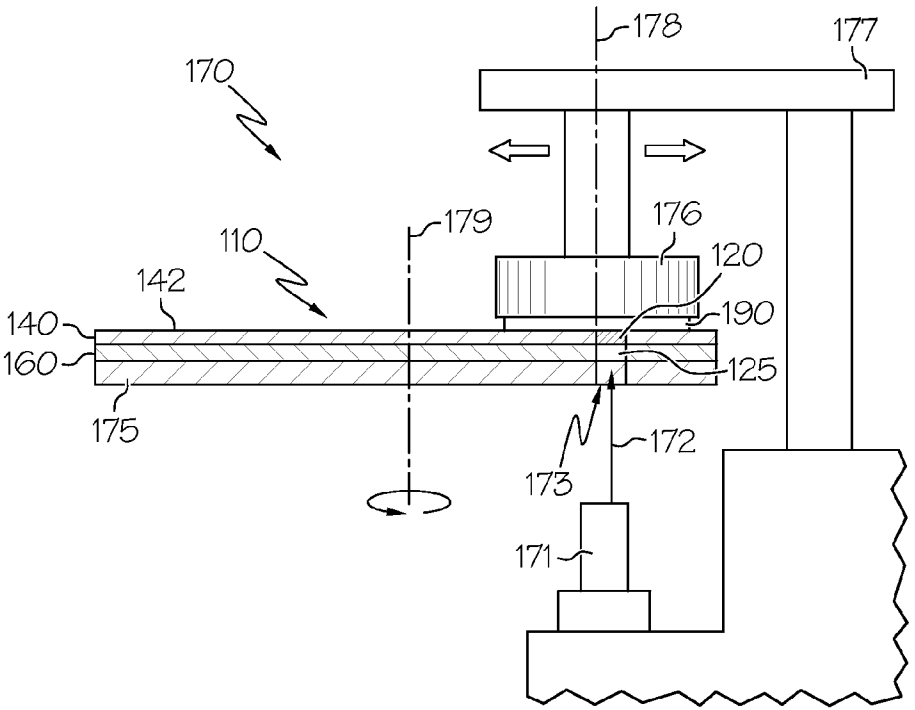
FIG. 6 is a depiction of a polishing machine utilizing a polishing pad of the present invention to polish a semiconductor wafer.

FIG. 6 is a depiction of a polishing machine 170 utilizing a polishing pad 110 of the present invention to polish a semiconductor wafer 190. The window polishing pad 110 has a base layer 160, a polishing layer 140 with a polishing surface 142, a pad window 120, a cavity 125, a pressure relief channel (not shown) and at least one semipermeable pad membrane (not shown). The polishing machine 170 has a platen 175 to which the window polishing pad 110 is interfaced. Specifically, the base layer 160 of the window polishing pad 110 is affixed to the platen 175. In some embodiments of the present invention, the window polishing pad 110 is affixed to the platen 175 using at least one of a pressure sensitive adhesive (not shown) and a vacuum (not shown). The polishing machine 170 has a wafer carrier 176 for holding or pressing a semiconductor wafer 190 against the polishing surface 142. In some embodiments of the present invention, the window polishing pad 110 is used in conjunction with a chemical polishing slurry (not shown) to polish the semiconductor wafer 190. Note, although not pictured, any means for providing a polishing slurry at the interface between the polishing surface 142 and the semiconductor wafer 190 can be utilized with polishing machine 170. The platen 175 and affixed window polishing pad 110 is typically rotated about the central axis 179 of the platen 175. The wafer carrier 176 is also usually rotated about its central axis 178, and translated across the surface of the polishing surface 142 via a translation arm 177. Note, although a single wafer carrier 176 is shown in FIG. 6, polishing machines may have multiple wafer carriers spaced circumferentially around the polishing platen.

In the polishing machine 170 depicted in FIG. 6, the platen 175 has a platen window or hole 173 that coincides with the pad window 120. The platen window or hole 173 and the pad window 120 provide optical access to the surface of semiconductor wafer 190 during polishing for accurate end-point detection, wherein a laser spectrophotometer 171 is provided below the platen 175 and projects a laser beam 172 to pass and return through the platen window or hole 173 and the pad window 120.

Figure 7:
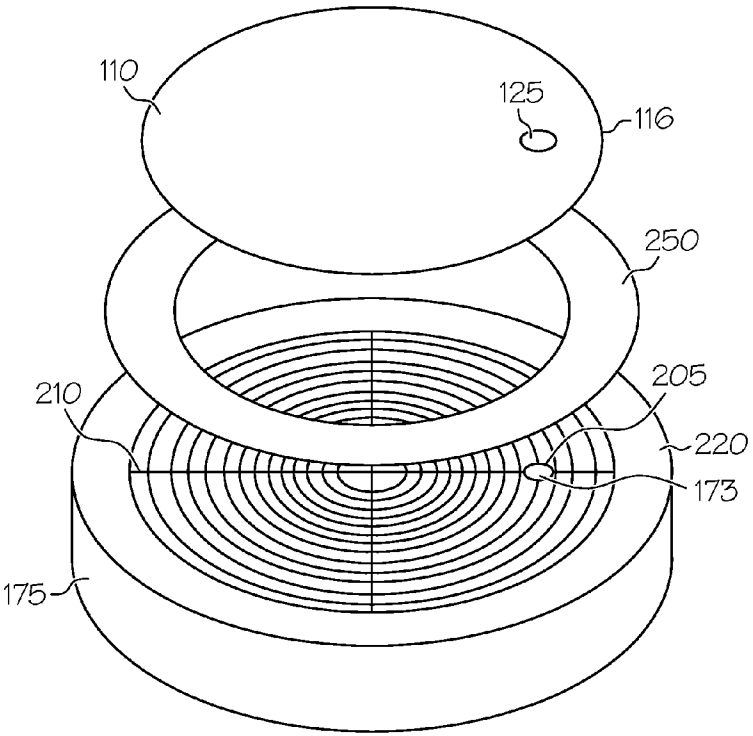
FIG. 7 is an exploded top and side perspective view of a platen, semipermeable platen membrane and a window polishing pad of the present invention, wherein the platen has a grooved top face.
Figure 8:
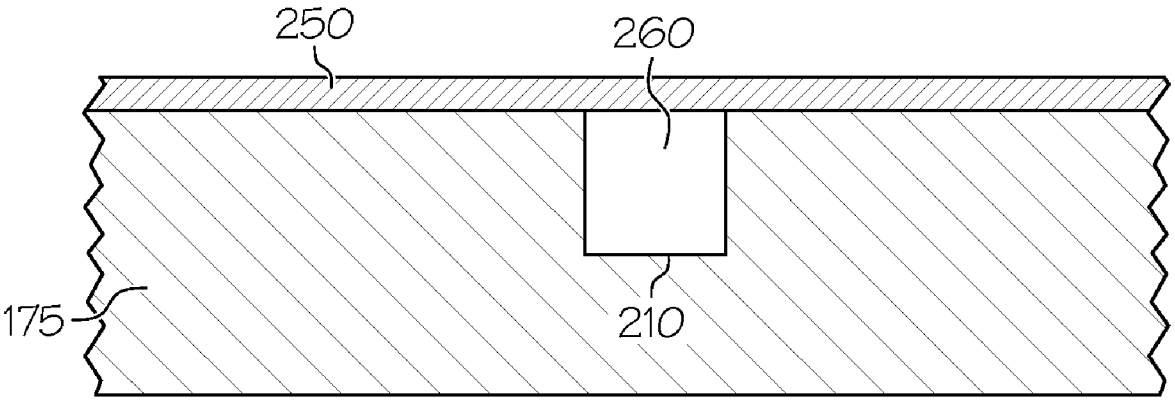
FIG. 8 is a cut-away, elevational view depicting a portion of a grooved platen, a compressible element and a platen membrane.

In some embodiments of the present invention, see for example FIG. 7, the platen 175 has grooves 210 that extend beyond the outer periphery 116 of the window polishing pad 110 during use when said window polishing pad is interfaced with the platen. In some aspects of these embodiments, the grooves 210 are formed on the top face 220 of the platen 175, which interfaces with the window polishing pad 110. The grooves 210 extend from or interconnect with an opening or openings 205 at cavity 125 of the window polishing pad 110 or the platen window or hole 173. In some aspects of these embodiments, the portion of the grooves 210 that are not shielded from exposure to polishing slurry or other process contaminants during polishing by the window polishing pad 110 are covered by a semipermeable platen membrane 250. In some aspects of these embodiments, the semipermeable platen membrane 250 is annular shaped. In some aspects of these embodiments, the semipermeable platen membrane 250 is interfaced with the platen 175 using an adhesive. In some aspects of these embodiments, see for example FIG. 8, the semipermeable platen membrane 250 is interfaced with the platen 175 using a compression element 260 that expands to seat itself within a portion of the grooves 210 and helps to anchor the semipermeable platen membrane 250 to the platen 175. In some aspects of these embodiments, the compression element comprises a porous, resilient polymeric material. In some aspects of these embodiments, the compression element comprises a spring metal.

We claim:

1. A chemical mechanical window polishing pad comprising:

a polishing layer having a polishing surface and a first aperture;

a base layer having a second aperture, wherein the base layer underlies the polishing layer and the second aperture is aligned with the first aperture; and, a pad window disposed within the first aperture;

wherein the window polishing pad has a pressure relief channel extending from an inlet at the second aperture to an outlet at an outer periphery of the window polishing pad; wherein the pressure relief channel does not extend to the polishing surface; wherein at least one of the inlet or outlet is covered with a semipermeable pad membrane and wherein the semipermeable pad membrane is gas permeable and liquid impermeable.

2. The window polishing pad of claim 1, further comprises a porous filler material disposed within the pressure relief channel.

3. The window polishing pad of claim 2, wherein the compressibility of the porous filler material is ±5% of the compressibility of the base layer.

4. The window polishing pad of claim 1, wherein the base layer has a notch at the outer periphery of the base layer and wherein the outlet coincides with the notch.

5. The window polishing pad of claim 1, wherein a portion of the pressure relief channel contains a porous filler material and wherein the semipermeable pad membrane is adhered to the filler material.

6. The window polishing pad of claim 1, wherein the outer periphery of the window polishing pad is hydrophobic.

7. A method for polishing a semiconductor wafer using the window polishing pad of claim 1, wherein the window polishing pad is interfaced with a platen of a polishing machine and wherein the semiconductor wafer is polished to an optically detected endpoint.

8. A method for making a window polishing pad, comprising:

providing a polishing layer having a polishing surface and a first aperture;

providing a base layer having a second aperture;

providing a pressure relief channel extending from an inlet at the second aperture to an outlet at an outer periphery of the window polishing pad;

providing a pad window;

providing a semipermeable pad membrane which is gas permeable and liquid impermeable;

adhering the pad window within the first aperture;

adhering the polishing layer to the base layer so that the first aperture and the second aperture are aligned; and, adhering the semipermeable pad membrane to the window polishing pad, such that the outlet from the pressure relief channel is covered by the semipermeable pad membrane; and, wherein the pressure relief channel does not extend to the polishing surface.

9. The method of claim 8, further comprising:

providing a porous filler material in the pressure relief channel.

10. The method of claim 8, further comprising:

providing an adhesive selected from a pressure sensitive adhesive and a hot melt adhesive; and using the adhesive to adhere the polishing layer to the base layer.

* * * * *